US009400487B2

(12) United States Patent
Goeller

(10) Patent No.: US 9,400,487 B2
(45) Date of Patent: Jul. 26, 2016

(54) WINDING DEVICE WITH UNIDIRECTIONAL DRIVE ARRANGEMENT

(71) Applicant: Montres Breguet SA, L'Abbaye (CH)

(72) Inventor: Eric Goeller, Colombier (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/929,708

(22) Filed: Nov. 2, 2015

(65) Prior Publication Data

US 2016/0132022 A1 May 12, 2016

(30) Foreign Application Priority Data

Nov. 7, 2014 (EP) ..... 14192336

(51) Int. Cl.
*G04B 5/02* (2006.01)
*G04B 3/00* (2006.01)

(52) U.S. Cl.
CPC .. *G04B 3/006* (2013.01); *G04B 5/02* (2013.01)

(58) Field of Classification Search
CPC ..... G04B 5/04; G04B 5/06; G04B 5/02; G04B 19/21; G04B 9/005; G04B 3/006
See application file for complete search history.

(56) References Cited

U.S. PATENT DOCUMENTS 6,685,352 B1 * 2/2004 Capt ..... G04B 9/005 368/206
7,287,901 B1 * 10/2007 Helfer ..... F16D 41/069 368/147
8,737,176 B2 * 5/2014 Bas ..... G04B 5/02 368/220
8,801,269 B2 * 8/2014 Grossenbacher ..... G04B 9/005 368/148
9,158,283 B2 * 10/2015 Cornibe ..... G04B 11/006
2015/0293500 A1 * 10/2015 Reynard ..... G04B 19/21 368/66

FOREIGN PATENT DOCUMENTS

| | | |
|---|---|---|
| CH | 173 803 | 12/1934 |
| CH | 308 939 | 8/1955 |
| CH | 308 940 | 8/1955 |

OTHER PUBLICATIONS

European Search Report issued Jul. 17, 2015 in European Application 14192336, filed on Nov. 7, 2014 ( with English Translation).

* cited by examiner

*Primary Examiner* — Sean Kayes
(74) *Attorney, Agent, or Firm* — Oblon, McClelland, Maier & Neustadt, L.L.P

(57) ABSTRACT

The winding device includes a solar pinion mounted for free rotation in a coaxial manner about a central arbor on a winding wheel. The device also includes toothed planetary wheels for meshing with a toothing of the solar pinion. The planetary wheels are mounted for free rotation with play about a respective offset arbor fixed to the winding wheel. The device also includes one or two hooks of a frame fixedly mounted on the winding wheel. In a first direction of rotation of the solar pinion, a planetary wheel is in a locking position in contact with a hook in order to drive the winding wheel. In a second direction of rotation opposite to the first direction of rotation, the planetary wheel is uncoupled so that the rotation of the solar pinion does not drive the winding wheel.

18 Claims, 3 Drawing Sheets

WINDING DEVICE WITH UNIDIRECTIONAL DRIVE ARRANGEMENT

This application claims priority from European patent application No. 14192336.7 filed Nov. 7, 2014, the entire disclosure of which is hereby incorporated herein by reference.

FIELD OF THE INVENTION

The invention concerns a winding device with a unidirectional drive arrangement for a watch. This device may be used for winding a mainspring for driving a timepiece movement or for driving, for example, a date disc or time correction disc. The device includes at least one solar drive pinion mounted for free rotation about a central arbor disposed coaxially on a winding wheel, which may be connected to the mainspring barrel of the timepiece movement.

BACKGROUND OF THE INVENTION

Usually, in a system for winding at least one barrel, or for setting the time or correcting the date, there is used a wheel with wolf teeth cooperating with two clicks. The two clicks are held by small springs against the wheel to prevent rotation in one direction and to allow free rotation in another direction. Another click must also be provided under the wheel of the frame to prevent the mainspring from being wound. This locking click under the wheel is difficult to access which makes disassembly difficult, especially of the barrel or parts connected to the barrel. This generally constitutes a drawback of such a winding system.

In EP Patent Application No. 0 278 338 A1, there is described a reverser mechanism for an automatic winding device using an oscillating weight of a watch movement. The mechanism includes a winding wheel, which is coaxially mounted with two wheels having wolf teeth, which are disposed on either side of the winding wheel. This winding wheel carries on each face thereof at least one click loaded by a spring and respectively cooperating with one of the wolf teeth wheels. This assembly is disposed in the kinematic chain of the movement, inserted between the oscillating weight and the mainspring barrel of the watch. These clicks are intended for the transmission of the rotation of the oscillating weight, and are arranged respectively hinged on pivoting members, which are integral with the winding wheel. Each pivoting member, which carries the click assigned to one direction of rotation of the oscillating weight, also serves as an anchoring member for the spring, which loads the click intended for the transmission of the other direction of rotation of said oscillating weight. However, this mechanism with the winding device includes too many parts, which makes maintenance of the watch difficult and constitutes a drawback.

EP Patent Application No. 2 221 676 A1 discloses a timepiece which includes a chronograph and a watch. The chronograph hands are driven by a first gear train, which in turn drives a first resonator. The watch hands are driven by a second gear train independent of the first gear train, which in turn drives a second resonator. The first and second gear trains are driven by a single energy source. The energy source is a barrel which rotates freely about an arbor and contains a mainspring. This mainspring may be wound by driving a wheel with wolf teeth mounted on the barrel arbor and impeded in one direction of rotation by clicks. However no unidirectional drive arrangement is defined in connection with the barrel.

CH Patent Application No. 173 803 A describes a device for winding a watch, which is a unidirectional drive arrangement. The device includes a solar drive pinion, which is mounted for free rotation about a central arbor coaxially secured to a winding wheel. It also includes a toothed planetary wheel for meshing with a toothing of the solar pinion. The toothed planetary wheel is mounted for free rotation about an offset arbor fixed to the wheel and parallel to the central arbor. It also includes a hook fixedly mounted to the winding wheel in order to mesh with the toothed planetary wheel in one direction of rotation. The device further includes a relatively complicated mechanical arrangement for allowing unidirectional driving, which is a drawback.

Reference may also be made to CH Patent Application Nos 308 939 A and 308 940 A, which describe a winding device, in a similar manner to CH Patent Application No. 173 803 A, and which also include a relatively complicated mechanical arrangement for allowing unidirectional driving, which is a drawback.

SUMMARY OF THE INVENTION

It is an object of the invention to overcome the aforementioned drawbacks of the state-of-the-art by providing a winding device with a unidirectional drive arrangement, which is of simple design and which can easily allow a part of the movement with the barrel to be maintained or disassembled for repair.

The invention therefore concerns a winding device with a unidirectional drive arrangement, for a watch, the device including at least one solar drive pinion mounted for free rotation about a central arbor integral with a winding wheel and arranged coaxially to said winding wheel, at least one toothed planetary wheel for meshing with a toothing of the solar pinion, the toothed planetary wheel being mounted for free rotation about an offset arbor parallel to the central arbor, the offset arbor being fixed to the winding wheel, and at least one hook fixedly mounted on the winding wheel, wherein the toothed planetary wheel is mounted for free rotation with a certain play about the offset arbor, wherein said device is arranged such that, in a first direction of rotation of the solar pinion, the toothing of the planetary wheel meshes with the hook to be in a locking position, such that the rotation of the solar pinion in the first direction of rotation drives the winding wheel, and wherein in a second direction of rotation opposite to the first direction of rotation, uncoupling of the planetary wheel occurs, such that the solar pinion rotates freely in the second direction of rotation without driving the winding wheel.

Particular embodiments of the winding device with a unidirectional drive arrangement are defined in the dependent claims 2 to 16.

One advantage of the winding device lies in the fact that there is no longer a requirement for multiple small springs and clicks preventing winding in order to obtain a unidirectional drive arrangement, particularly to be used for winding a mainspring. This differs from winding systems of the prior art. In this case, the winding device allows the mainspring to be loaded or wound by an action directly on the central arbor connected to the centre of the barrel. The central arbor may be connected to an inner end of the mainspring. In a first direction of rotation of a solar pinion of the device, the winding wheel connected to the central arbor is driven in rotation to wind the spring. In a second direction of rotation of the solar pinion, uncoupling occurs without driving the winding wheel.

One advantage of the winding device lies in the fact a lower portion of the solar pinion includes truncated teeth to facilitate the locking of each toothed planetary wheel in contact with at least one hook in the first direction of rotation of the solar pinion. Each toothed planetary wheel is mounted with a certain play about an offset arbor fixed to the winding wheel. This makes it possible to obtain a locking position in a first direction of rotation of the solar pinion and an uncoupling or free rotation position in a second direction of rotation of the solar pinion.

To this end, the invention concerns an assembly for the winding of at least one mainspring of at least one barrel of a timepiece movement of a watch by means of a winding device, wherein the central arbor of the device is connected to one end of the mainspring in order to be wound during rotation of the solar pinion in the first direction of rotation.

A particular embodiment of the assembly is defined in the dependent claim 18.

BRIEF DESCRIPTION OF THE DRAWINGS

The objects, advantages and features of the winding device with a unidirectional drive arrangement will appear more clearly in the following description, based on at least one non-limiting embodiment illustrated by the drawings, in which.

DETAILED DESCRIPTION OF THE INVENTION

In the following description, reference is mainly made to the operation of the winding device with a unidirectional drive arrangement notably for winding a barrel mainspring of a mechanical watch. However, it is also possible to envisage using such a winding device to act on one or more date discs or time indicator hands.

Figure 1A:
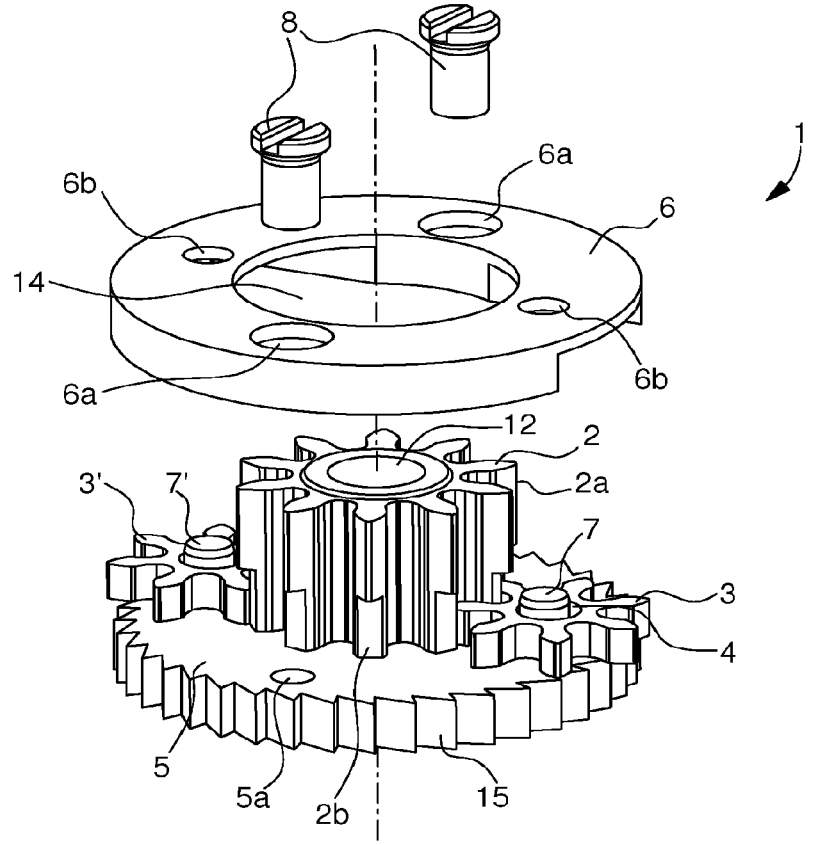
FIGS. 1*a* and 1*b* show exploded three-dimensional top and bottom views of the winding device with a unidirectional drive arrangement according to the invention.
Figure 1B:
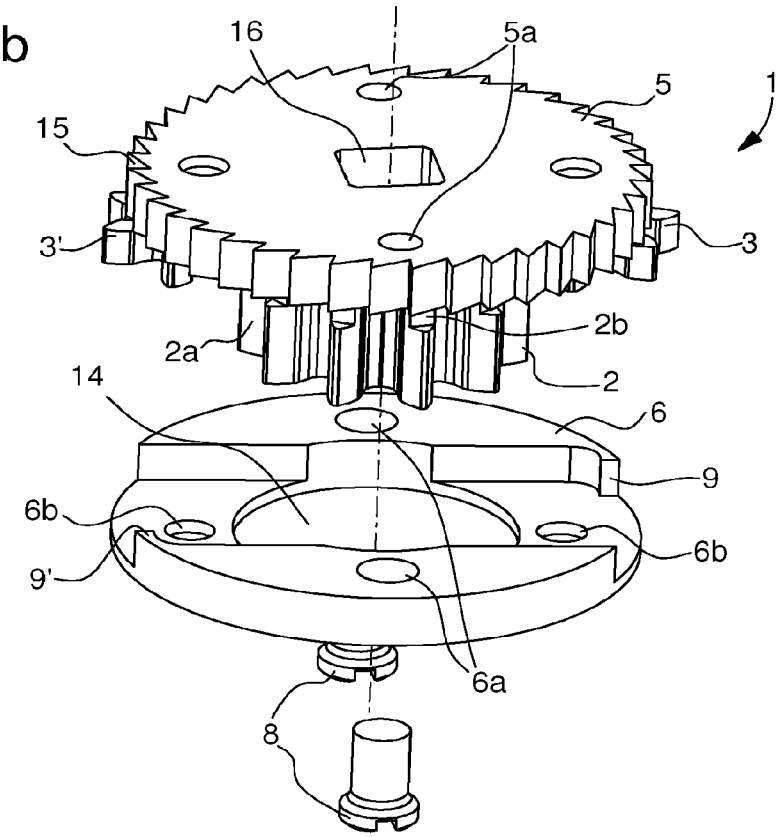
Figure 2:
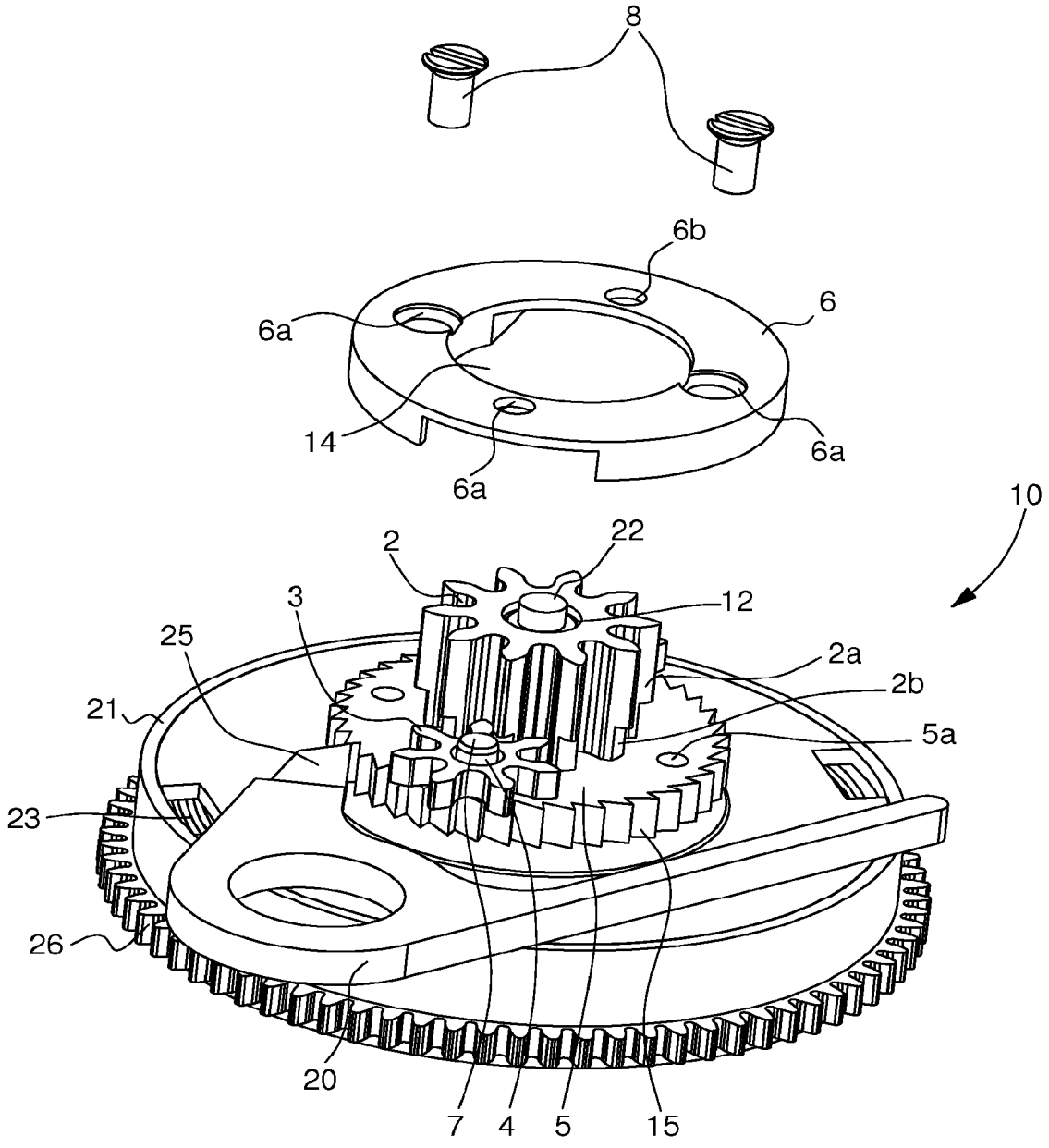
FIG. 2 shows a slightly exploded three-dimensional view of an assembly including a barrel, a click member and the winding device according to the invention.

FIGS. 1*a* and 1*b* show an exploded top and bottom view of a winding device 1 with a unidirectional drive arrangement. Winding device 1 includes a solar pinion 2 mounted for free rotation on a winding wheel 5, which may be a wheel with wolf teeth 15. Solar pinion 2 is disposed coaxially on a surface of winding wheel 5. As shown in FIG. 2, solar pinion 2 is mounted for free rotation about a central shaft or arbor 22 (not shown in FIGS. 1*a* and 1*b*), which is inserted in a tubular opening 12 of solar pinion 2 of substantially similar diameter.

Winding device 1 also includes at least one toothed planetary wheel 3 for meshing with a toothing of solar pinion 2. Toothed planetary wheel 3 is mounted for free rotation with a certain play 4 about an offset shaft or arbor 7 parallel to central arbor 22. This offset arbor 7 is fixed perpendicularly to winding wheel 5. The diameter of the opening of toothed planetary wheel 3 may be between 20% and 30%, and preferably close to 25%, of the diameter of offset arbor 7 to define the certain free rotational play.

Figure 3A:
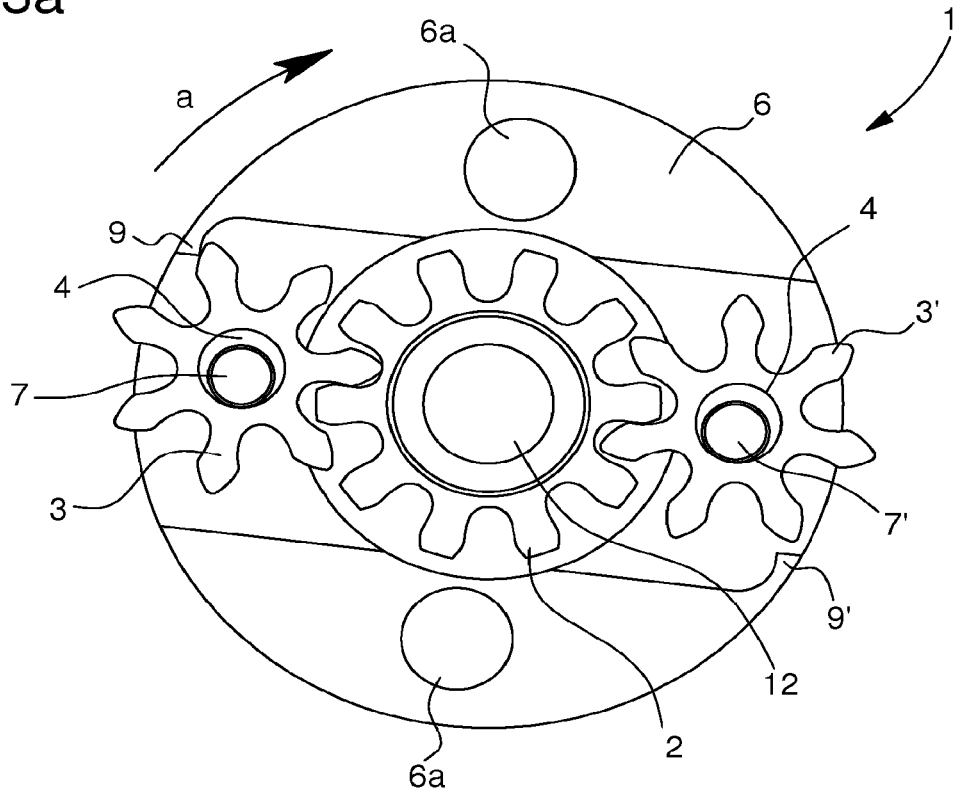
FIGS. 3*a* and 3*b* show a partial top view of the winding device in a drive direction of rotation and an opposite uncoupling direction of rotation according to the invention.

Winding device 1 also includes at least one hook 9, fixedly mounted on winding wheel 5, in order to mesh with a tooth of toothed planetary wheel 3 according to the position of toothed wheel 3 about offset arbor 7. In a first direction of rotation of solar pinion 2 which is direction "a" shown in FIG. 3*a* in the clockwise direction, the toothing of toothed planetary wheel 3 thus meshes with said hook 9 and is therefore in a locking position. At least one tooth of toothed planetary wheel 3 is also locked between two teeth of solar pinion 2. In this locking position of toothed planetary wheel 3, the rotation of solar pinion 2 in the first direction of rotation drives winding wheel 5, which allows a barrel mainspring to be wound, as explained below with reference to FIG. 2.

Figure 3B:
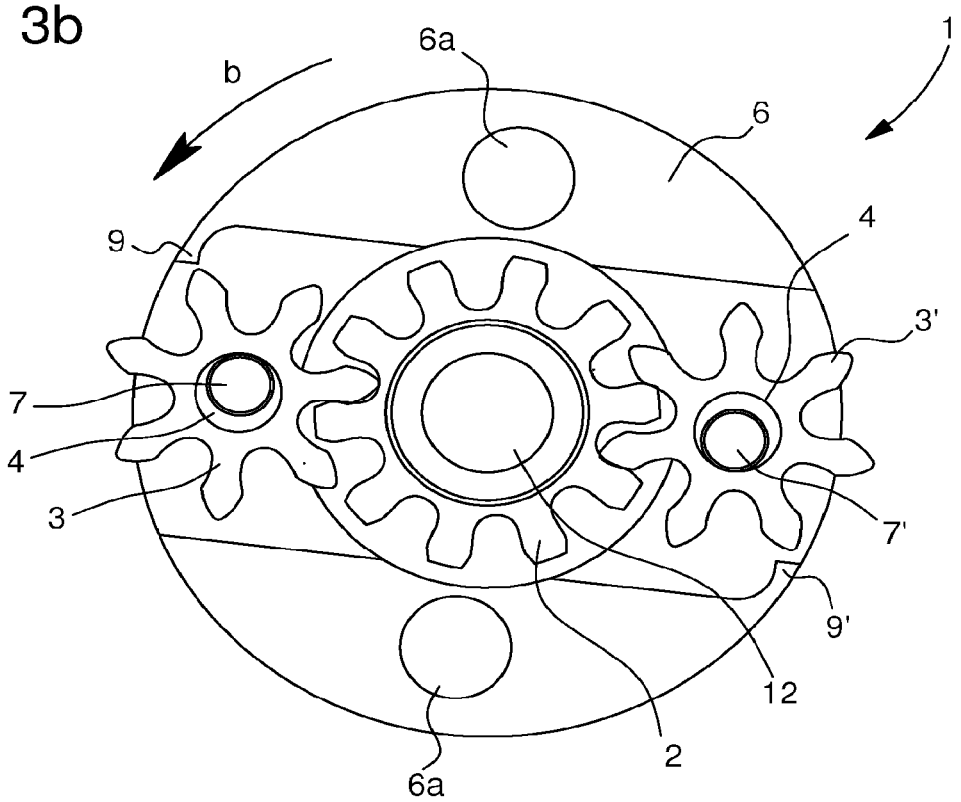

In a second direction of rotation of solar pinion 2, which is opposite to the first direction of rotation and which is the direction "b" shown in FIG. 3*b*, planetary wheel 3 is uncoupled. This means that, due to play 4 of the opening of toothed planetary wheel 3 around offset arbor 7, the rotation of the pinion in the second direction of rotation has the effect of moving toothed planetary wheel 3 away from hook 9. Thus, solar pinion 2 rotates freely in the second direction of rotation without driving winding wheel 5 with the free rotation of toothed planetary wheel 3.

Preferably, as shown in FIGS. 1*a* and 1*b*, two toothed planetary wheels 3, 3' are provided, each meshing with the toothing of solar pinion 2. Each toothed planetary wheel 3, 3' is mounted for free rotation with a certain play 4 around a respective offset arbor 7, 7' parallel to central arbor 22. The two offset arbors 7, 7' are fixed to winding wheel 5. The two toothed planetary wheels 3, 3' may have an equivalent diameter. The two offset arbors 7, 7' of the two planetary wheels 3, 3' are equidistant from central arbor 22 and preferably disposed at 180° from each other with respect to central arbor 22.

With the two toothed planetary wheels 3, 3', winding device 1 may also include two hooks 9, 9' fixedly mounted on winding wheel 5. A first hook 9 is opposite the first toothed planetary wheel 3, whereas a second hook 9' is opposite the second toothed planetary wheel 3'. When solar pinion 2 is driven in rotation in the first direction of rotation, at least one of the toothed planetary wheels 3, 3' meshes in a locking position with at least one of hooks 9, 9'. This allows winding wheel 5 to be driven in rotation. In the second direction of rotation of solar pinion 2, the tooth planetary wheels are uncoupled and do not drive winding wheel 5.

Winding device 1 preferably also includes a frame 6 fixedly mounted in a coaxial manner on winding wheel 5. This frame encloses in a housing toothed planetary wheel 3 or toothed planetary wheels 3, 3'. The housing includes an upper wall covering toothed planetary wheels 3, 3' and two side walls parallel to each other and to the line joining central arbor 22 and offset arbors 7, 7'. The distance separating each side wall is substantially similar to the diameter of solar pinion 2. Preferably, the housing is open on two opposite sides allowing a portion of each planetary wheel 3, 3' to pass. Frame 6 includes at least the first hook 9 for impeding rotation of toothed planetary wheel 3 in the first direction of rotation of solar pinion 2. According to the embodiment of FIGS. 1*a* and 1*b*, frame 6 preferably includes the first and second hooks 9, 9' respectively opposite first and second toothed planetary wheels 3, 3'. These two hooks 9, 9' are disposed at the periphery of frame 6 and on an inner side of frame 6. The two hooks 9, 9' are integral with the other parts of the frame.

Since the two toothed planetary wheels 3, 3' have the same diameter, the two hooks 9, 9' are equidistant from central arbor 22. They are each made in the form of a portion that curves inwardly from one of the respective side walls of the housing of the frame, which encloses the two planetary wheels 3, 3'. The two hooks 9, 9' are arranged at 180° from each other with respect to central arbor 22. One of the hooks is made at the periphery of frame 6 on one of the side walls of the housing, and the other hook is made at the periphery of frame 6 on the other side wall. With respect to the centre of central arbor 22, the two hooks 9, 9' are offset by an angle comprised between 20° and 30°, preferably 25°, from the two toothed planetary wheels 3, 3'. They are offset by an angle of between 20° and 30° in the first direction of rotation of solar pinion 2.

The two hooks 9, 9' in frame 6 may also be arranged offset at an angle of between 20° and 30° in the second direction of rotation of solar pinion 2 in the embodiment of FIGS. 1*a* and 1*b*. In such case, this is the reverse of the operating arrangement of winding device 1 described with reference to FIGS. 1*a* and 1*b*. In this device where operation is reversed, the first direction of rotation of solar pinion 2 for the locking position corresponds to the second direction of rotation of solar pinion 2 shown in FIGS. 1*a* and 1*b*. The second direction of rotation of the reverse operation device corresponds to the first direction of rotation of solar pinion 2 shown in FIGS. 1*a* and 1*b* with uncoupling of the toothed planetary wheels. Winding wheel 5 can be rotated inversely to the embodiment of FIGS. 1*a* and 1*b*.

Frame 6 is fixed on winding wheel 5, which is a wheel with wolf teeth 15, by two screws 8 inserted in openings 6*a* of the frame and screwed into threaded openings 5*a* of winding wheel 5. Openings 6*a* are made in a solid part of the frame and are arranged in a perpendicular direction to the direction of offset arbors 7, 7' of toothed planetary wheels 3, 3'. Frame 6 also includes two passage openings 6*b* for offset arbors 7, 7' in order to hold toothed planetary wheels 3, 3' locked between winding wheel 5 and the interior of the housing of frame 6.

The frame also includes an upper opening 14 for the passage of an upper portion 2*a* of solar pinion 2. This upper portion 2*a* of solar pinion 2, which projects from frame 6 fixed to winding wheel 5, is capable of being driven in rotation in the first direction of rotation and the second direction of rotation by a toothed drive wheel (not shown). This toothed drive wheel is connected to an oscillating mass (not shown) of a timepiece movement of the watch. Solar pinion 2 also includes a lower portion 2*b* for meshing with the toothed planetary wheel or wheels 3, 3'. The teeth of lower portion 2*b* of solar pinion 2 are truncated to facilitate the locking of at least one tooth of the toothed planetary wheel or wheels 3, 3' between two teeth of lower portion 2*b*. The locking of at least one of toothed planetary wheels 3, 3' occurs in the first direction of rotation of solar pinion 2.

It is also to be noted that winding wheel 5 includes a central opening 16, which is of rectangular section for cooperating with a complementary-shaped portion of central arbor 22. This makes central arbor 22 integral with winding wheel 5 during the rotation of winding wheel 5. A low portion (not shown) of central arbor 22 is intended to be connected to one end of a mainspring 23 of the barrel 21, shown in FIG. 2, in order to wind the spring during rotation of solar pinion 2 in the first direction of rotation.

To define certain dimensions of the components of winding device 1, the external diameter of each toothed planetary wheel 3, 3' could be between 1.3 and 1.5 times smaller than the external diameter of solar pinion 2. For example, the external diameter of each toothed planetary wheel 3, 3' could be on the order of 3 mm and the external diameter of solar pinion 2 on the order of 4 mm. The diameter of tubular opening 12 of solar pinion 2 could be on the order 1.5 mm. The diameter of each offset arbor may be on the order of 0.7 mm, whereas axial opening 4 of each toothed planetary wheel 3, 3' may be on the order of 0.9 mm. Each hook 9, 9' may be on the order of 2.6 mm from the centre of central arbor 22. With such dimensions, toothed planetary wheels 3, 3' may comprise 7 teeth, whereas solar pinion 2 may comprise 10 teeth.

Referring to FIG. 2, there is now explained an assembly 10 for winding at least one mainspring 23 of at least one barrel 21 of a timepiece movement of a watch, by means of a winding device 1. Winding device 1 is mounted on an upper surface of a cage 21 of the barrel via its winding wheel 5. A drive wheel 26 of a gear chain of the timepiece movement is arranged on a lower surface of cage 21 of the barrel. Drive wheel 26 may be connected to an outer end of mainspring 23.

The lower portion of central arbor 22 of the device is connected to an inner end of mainspring 23. The attached end of mainspring 23 is on the centre side of the spiral spring. Mainspring 23 can thus be wound during the rotation of solar pinion 2, particularly in the first direction of rotation. To achieve this, the upper portion 2*a* of solar pinion 2 can mesh with a toothed drive wheel (not shown) connected to an oscillating weight of a timepiece movement.

Assembly 10 also includes a locking click 20, which is normally mounted on an assembly bridge or plate of the timepiece movement, which is not shown. One tooth 25 of looking click 20 impedes the rotation, in one direction of rotation, of winding wheel 5, which is a wheel with wolf teeth 15. Tooth 25 impedes the rotation of the wheel with wolf teeth 15 in the second direction of rotation of the winding device 1 shown with reference to FIGS. 1*a* and 1*b*.

In a more developed embodiment of assembly 10, it is possible to provide a first mainspring 23 of a first barrel 21, which can be wound by means of a first winding device 1 shown in FIG. 2, and (not shown) a second mainspring of a second barrel, which can be wound by means of a second winding device of reverse operation to the first winding device. In such case, the toothed drive wheel connected to an oscillating weight of a timepiece movement is arranged to mesh with the upper portions of the solar pinions of the first and second winding devices. The first spring is wound in the first direction of rotation of the solar pinion of the first winding device, whereas the second spring is wound in the first direction of rotation of the solar pinion of the second winding device, which is opposite to the first direction of rotation of the first winding device.

From the description that has just been given, several variant embodiments of the winding device can be devised by those skilled in the art without departing from the scope of the invention defined by the claims. More than two toothed planetary wheels may be provided, respectively cooperating with more than two hooks. The winding device may also be used for setting the time and activated by means of a stem crown of the watch.

What is claimed is:

1. A winding device with a unidirectional drive arrangement for a watch, the device including at least one solar drive pinion mounted for free rotation about a central arbor integral with a winding wheel and arranged coaxially to said winding wheel, at least one toothed planetary wheel for meshing with a toothing of the solar pinion, the toothed planetary wheel being mounted for free rotation about an offset arbor parallel to the central arbor, the offset arbor being fixed to the winding wheel, and at least one hook fixedly mounted on the winding wheel, wherein the toothed planetary wheel is mounted for free rotation with a certain play about the offset arbor, wherein said device is arranged such that, in a first direction of rotation of the solar pinion, the toothing of the planetary wheel meshes with the hook to be in a locking position, such that the rotation of the solar pinion in the first direction of rotation drives the winding wheel, and wherein in a second direction of rotation opposite to the first direction of rotation, uncoupling of the planetary wheel occurs, such that the solar pinion rotates freely in the second direction of rotation without driving the winding wheel.

2. The device according to claim 1, wherein the device further includes a frame fixedly mounted in a coaxial manner on the winding wheel, said frame enclosing the toothed planetary wheel in a housing, and in that the frame includes the hook for impeding the rotation of the toothed wheel in the first direction of rotation of the solar pinion.

3. The device according to claim 2, wherein the hook is arranged at the periphery of the frame and on an inner side of the frame, and in that the hook is integral with the frame.

4. The device according to claim 2, wherein the frame includes two hooks arranged at the periphery of the frame and on an inner side of the frame, and in that the two hooks are equidistant from the central arbor.

5. The device according to claim 4, wherein the two hooks are arranged at 180° from each other with respect to the central arbor.

6. The device according to claim 5, wherein the housing of the frame includes an upper wall covering the toothed planetary wheel and two side walls parallel to each other and to the line joining the central arbor and the offset arbor, wherein a first hook is made at the periphery of the frame on one of the side walls of the housing, and in that a second hook is made at the periphery of the frame on the other side wall.

7. The device according to claim 4, wherein each hook is offset by an angle comprised between 20° and 30°, preferably 25°, from the central arbor with respect to the line joining the centre of the central arbor and the offset arbor and in the first direction of rotation of the solar pinion.

8. The device according to claim 2, wherein the frame includes an opening for the passage of an upper portion of the solar pinion.

9. The device according to claim 8, wherein the solar pinion includes the upper portion capable of being driven in rotation in the first direction of rotation and the second direction of rotation by a toothed drive wheel connected to an oscillating weight of a timepiece movement of the watch, and a lower portion for meshing with the toothed planetary wheel.

10. The device according to claim 9, wherein the teeth of the lower portion of the solar pinion are truncated to facilitate the locking of at least one tooth of the toothed planetary wheel between two teeth of the lower portion in the locking position in the first direction of rotation of the solar pinion.

11. The device according to claim 1, wherein the device includes two toothed planetary wheels each for meshing with the toothing of the solar pinion, each toothed planetary wheel being mounted for free rotation with a certain play about a respective offset arbor parallel to the central arbor, the offset arbors being fixed to the winding wheel.

12. The device according to claim 11, wherein the two toothed planetary wheels have the same diameter, in that the two offset arbors of the two planetary wheels are equidistant from the central arbor and are preferably disposed at 180° from each other with respect to the central arbor.

13. The device according to claim 11, wherein the device includes two hooks fixedly mounted on the winding wheel, a first hook being opposite the first toothed planetary wheel, whereas a second hook is opposite the second toothed planetary wheel, and wherein during the rotation of the solar pinion in the first direction of rotation, at least one of the toothed planetary wheels meshes in a locking position with at least one of the hooks so as to drive the winding wheel in rotation.

14. The device according to claim 11, wherein the two toothed planetary wheels are enclosed in a housing of a frame, which is fixedly mounted in a coaxial manner on the winding wheel, and wherein the frame includes two inner hooks arranged at 180° from each other with respect to the central arbor for impeding the rotation of at least one of the toothed wheels in the first direction of rotation of the solar pinion.

15. The device according to claim 1, wherein the winding wheel is a wheel with wolf teeth capable of cooperating with a tooth of a locking click of the wheel in the second direction of rotation.

16. The device according to claim 15, wherein the wheel with wolf teeth includes a central opening of rectangular section for cooperating with a complementary-shaped portion of the central arbor so as to make the central arbor integral with the wheel with wolf teeth during rotation of the wheel with wolf teeth, the central arbor being intended to be connected to one end of a mainspring of a barrel in order to wind the spring during rotation of the solar pinion in the first direction of rotation.

17. An assembly for winding at least one mainspring of at least one barrel of a timepiece movement of a watch, by means of a winding device according to claim 1, wherein the central arbor of the device is connected to one end of the mainspring in order to be wound during rotation of the solar pinion in the first direction of rotation.

18. The assembly according to claim 17 for winding a first mainspring of a first barrel of a timepiece movement of a watch, by means of a first winding device, and a second mainspring of a second barrel by means of a second winding device of reverse operation to the first winding device, wherein a toothed drive wheel connected to an oscillating weight of a timepiece movement is arranged to mesh with the upper portion of the solar pinion of the first winding device and with the upper portion of the solar pinion of the second winding device so as to wind the first mainspring by the first winding device in the first direction of rotation of the solar pinion thereof and to wind the second mainspring by the second winding device in a first direction of rotation of the solar pinion thereof, which is opposite to the first direction of rotation of the first winding device.

* * * * *